United States Patent [19]

Newbold

[11] Patent Number: 5,051,073

[45] Date of Patent: Sep. 24, 1991

[54] BICYCLE PUMP

[76] Inventor: Dixon Newbold, 765 Allen's Ave., Providence, R.I. 02905

[21] Appl. No.: 359,124

[22] Filed: May 31, 1989

[51] Int. Cl.[5] ..... F04B 21/04

[52] U.S. Cl. ..... 417/526; 417/527; 417/550

[58] Field of Search ..... 417/525, 526, 527, 547, 417/550

[56] References Cited

U.S. PATENT DOCUMENTS

| | | | |
|---|---|---|---|
| 654,706 | 7/1900 | Braymer | 417/547 |
| 1,192,509 | 7/1916 | Feeny | 417/547 |
| 1,491,388 | 4/1924 | Foster | 417/526 |
| 2,683,060 | 7/1954 | Wise et al. | 417/547 |
| 3,190,266 | 6/1965 | Malec | 417/547 |
| 3,329,068 | 7/1967 | Klaus | 92/112 |
| 3,904,325 | 9/1975 | Olofsson et al. | 417/525 |
| 3,981,625 | 9/1976 | Wickenberg | 417/63 |

FOREIGN PATENT DOCUMENTS

| | | | |
|---|---|---|---|
| 696168 | 8/1953 | United Kingdom | 417/526 |

*Primary Examiner*—Leonard E. Smith

*Assistant Examiner*—Michael I. Kocharov

*Attorney, Agent, or Firm*—Wolf, Greenfield & Sacks

[57] ABSTRACT

A hand pump having a cylinder and piston in which the piston head is formed with an annular channel having an opening in the base of the annular channel in free communication with the interior of a hollow piston rod. A pair of radially-projecting stops extend outwardly from the base of the channel adjacent the opening. A pair of O-rings are positioned within the channel with one on either side of the stops with the O-rings having an inner diameter closely fitting the surface of the base and an outer diameter when in an unstressed position engage in a sliding relation the inner surface of the cylinder. Chambers are formed on either end of the piston head and are provided with valve inlets. In operation the O-rings are alternately flexed about the stops to create an air passage between the flexed O-ring and the inner surface of the cylinder depending upon the relative direction of movement of the head to the inner surface of the cylinder wall, whereby air may be forced from one or the other chambers through the hole and into the hollow piston rod.

15 Claims, 4 Drawing Sheets

BICYCLE PUMP

SUBJECT MATTER OF INVENTION

The present invention relates to a valve construction and in particular a valve construction primarily designed for hand pumps.

BACKGROUND OF INVENTION

Currently commercially available bicycle pumps are intended to be rugged, lightweight, easy to manufacture and repair, simple to operate and relatively efficient. Exemplary of the currently available bicycle pumps are those which use the construction illustrated in U.S. Pat. No. 3,981,625 which issued on Sept. 21, 1976 to Wickenberg. In that arrangement the piston head is formed with a specially-designed and shaped annular seal having a V-shaped cross section. Since that seal forms an integral dynamic part of the piston construction and is in constant movement when in use, it tends to wear. Unfortunately, because it is specially shaped, it is not easily replaced. Consequently, on wearing of that particular component the pump may become virtually useless. Thus, the unavailability of a replacement component at a relatively low cost and from an easily-accessible source limits the overall utility and worth of the pump. In addition, the special shape of these members subject them to increased manufacturing cost.

There are a number of other patents that have issued relating to valve constructions for pumps, which have a variety of limitations, that make the valve designs unsuited for current commercial pumps, and in particular unsuited for bicycle pumps. These patents include U.S. Patent No. 1,192,509 which issued July 25, 1916 to Feeny; U.S. Pat. No. 2,683,060 which issued July 6, 1954 to Wise; U.S. Pat. No. 654,706 which issued July 31, 1900 to Braymer; U.S. Pat. No. 3,329,068 which issued July 4, 1967 to Klaus and U.S. Pat. No. 3,190,2666 which issued June 22, 1965 to Malec. While not all of these disclose hand pumps primarily designed for bicycles, they all disclose valve constructions of various designs. None of these valve constructions, however, appear to be more-relevant than U.S. Pat. No. 3,981,625 referred to above.

SUMMARY OF THE INVENTION

It is an object of the invention to overcome the limitations of the prior art as described above. Specifically it is an object of the invention to provide an improved valve construction for use in a pump such as a bicycle pump.

A further object of the invention is to provide a pump having a unique valve that is simple and inexpensive to manufacture, and which may be repaired using commonly available and standard components.

A further object of the present invention is to provide an improved pump which is made with few components.

Yet another object of the present invention is to to provide an improved pump that is rugged in construction, and which has components designed for minimal wear and simple and inexpensive replacement.

In the present invention there is provided an air pump having a cylinder with a piston slidably positioned within the cylinder. The piston has a hollow piston rod attached at one end to a piston head. The piston head defines a pair of air chambers, one on each side of the piston head. The piston head is formed with an annular channel having an opening in the base of the channel communicating with the hollow piston rod. A pair of O-rings are positioned within the channel, one on each side of the opening. The O-rings are separated by a plurality of stops extending radially from the base of the channel adjacent the opening. The O-rings are adapted to be flexed about the stops from their normal engagement with the interior wall of the pump cylinder upon movement of the piston relative to the cylinder, whereby air being compressed in a chamber will pass between a flexed O-ring and the side wall of the channel, into the opening in the channel and through the hollow piston rod.

DETAILED DESCRIPTION OF THE DRAWINGS

Figure 1:
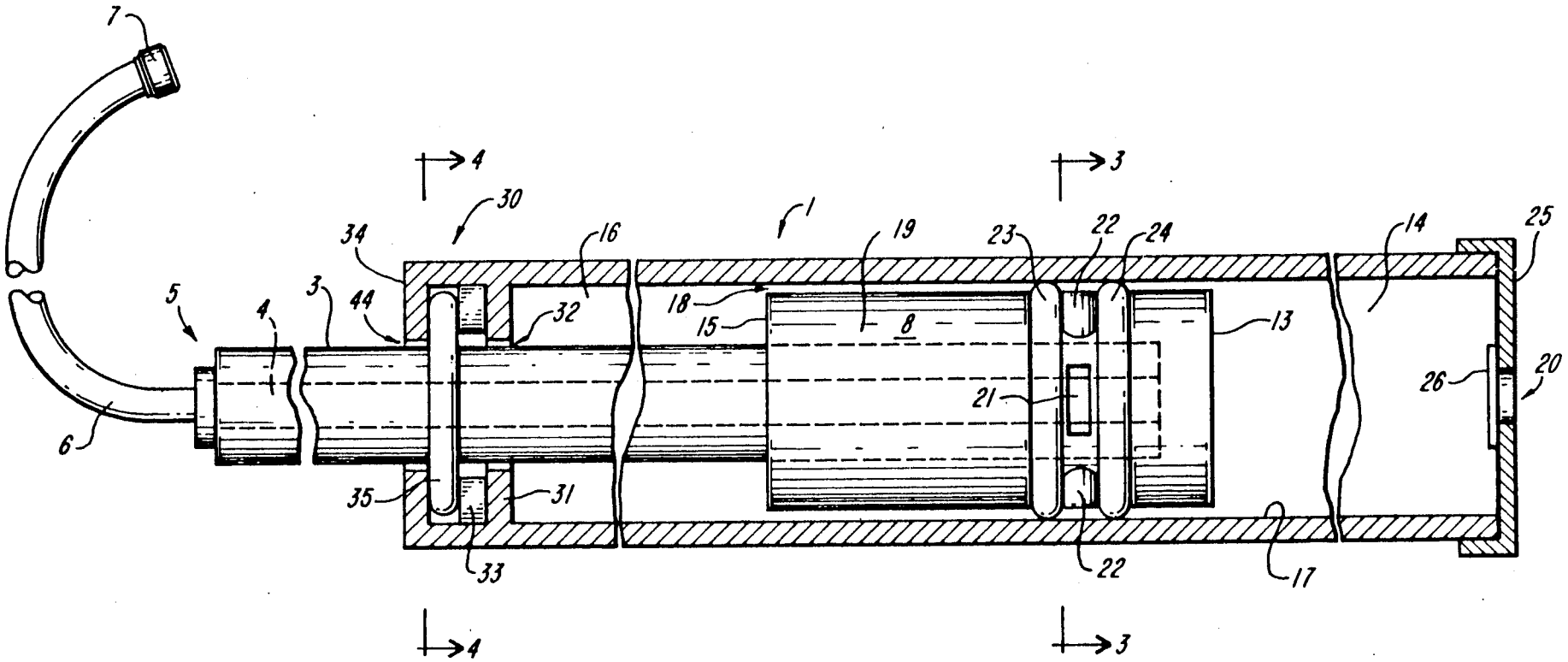
FIG. 1 is a partially cross sectioned view of a hand pump embodying the invention.
Figure 2:
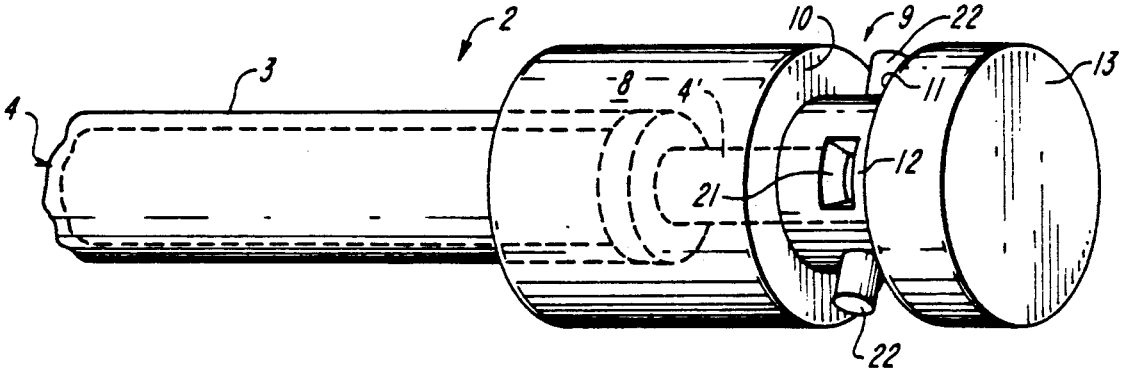
FIG. 2 is a side view of the piston of the invention.
Figure 3:
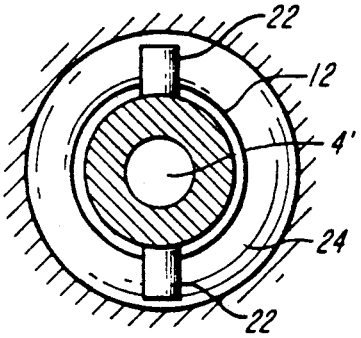
FIG. 3 is a cross sectional view taken substantially along the line 2—2 of FIG. 1.

The hand pump in the particular embodiment illustrated is designed for use as a bicycle tire pump. However, the principles described may be used for other types of pumps and in particular for other types of hand pumps.

In this embodiment the pump includes an elongated cylinder 1 of conventional shape and formed of a suitable material such as metal. A piston 2 is adapted to slide longitudinally within the cylinder. Piston 2 includes a tubular piston rod 3 defining a longitudinally-extending internal passage 4. The piston rod 3 has two ends, an inner end attached to a piston head within the cylinder 1 and an outer end 5 extending from the cylinder 1. A flexible hose 6 connects the outer end 5 of the piston rod 3 to a valve connector 7 for attachment to a bicycle tire valve. Suitable means may be used for attaching the flexible hose 6 to the end 5 of the piston rod 3.

The inner end of the piston rod 3 is connected to a piston head 8 positioned within the cylinder 1. The piston head 8 is formed with an annular channel 9 for receiving a pair of O-rings. The channel 9 is defined by parallel side walls 10 and 11 and a cylindrical base 12. The cylindrical base 12 has an opening 21 communicating with the piston rod passage 4. The passage 4 in the piston rod 3 thus extends from the outer end 5 of the piston rod 3 and communicates with the opening 21 in the base of the annular channel 9 so that air or fluid may freely pass from the annular channel 9, through the opening 21 into the passage 4 and consequently through the flexible tube 6 to a tire.

The piston head 8 divides the cylinder 1 into two separate chambers. One end 13 of the piston head 8 faces and defines a first chamber 14 and the opposite end 15 of the piston head 8 faces and defines a second chamber 16. The piston head 8 has an outer cylindrical wall that is spaced from the inner surface 17 of the cylinder 1, thus defining an annular air passage 18 between the inner surface 17 and the outer cylindrical wall 19 of the piston head 8. This air passage 18 provides for fluid communication between the chambers 14, 16 and the opening 21 in the base of the annular channel 9.

A pair of stop means 22 extend outwardly from the base 12 of the annular channel in normal alignment with the opening 21. Preferably these stop means consist of pins or the like that project from the base 12 at least half the radial distance between the base and the inner surface 17 of the cylinder. These pins, however, do not project beyond the outer diameter of the piston head.

A pair of O-rings 23 and 24 are positioned on the annular channel 9, sandwiched about the stop means 22. The adjacent sides of the O-rings 23 and 24 engage the stop means 22 and the respective outer sides of the O-rings 23 and 24 engage respectively the side walls 10 and 11 of the annular channel 9. In the nondynamic state illustrated in FIG. 1, the outer diameters of the O-rings 23 and 24 engage inner surface 17 of the cylinder in a sliding fit. The inner diameters of the O-rings 23 and 24 are spaced from the cylindrical base 12 of the annular channel 9.

The end of the cylinder facing chamber 14 has a cap 25 provided with a cap opening 20 for permitting air to enter chamber 14. The cap opening 20 is associated with a structure which permits air to be pulled through the opening and into chamber 14 as the piston head 8 moves axially away from the cap 25 to expand chamber 14, but prevents air from escaping through the opening when piston head 8 moves axially toward the cap 25. The structure may comprise a one-way valve 26 which permits air to enter chamber 14 through the cap opening 20, but will prevent air in chamber 14 from escaping through the cap opening 20.

The other end of the cylinder 1 is closed by a valve means 30. Although conventional valve means are suitable, the preferred valve means 30 is constructed similar to the novel O-ring/stop means arrangement of the piston head 8. This valve means 30 may include an inwardly-extending annular flange 31 which is secured at its outer periphery to the inner surface 17 of the cylinder 1. The inner diameter of this flange 31 defines an opening through which the piston rod 3 extends. The inner diameter is spaced from the outer surface of piston rod 3 to define an annular air passage 32. Stop means are formed on the side of the flange 31 facing away from chamber 15. This stop means may comprise ribs 33 or other projections extending from the surface of the flange 31.

The valve means 30 also includes the end wall 34 of the cylinder 1. The end wall 34, together with the annular flange 31, define an annular channel constructed and arranged to snugly receive an O-ring 35, the O-ring being captured between the end wall 34 and the ribs 33. Thus, ribs 33 engage O-ring 35 at only limited portions about the circumference of O-ring 35. The O-ring 35 has an inner diameter that fits against the outer surface of piston rod 3 to form an air-tight seal The outer diameter of the O-ring 35 in its normal non-dynamic position is spaced slightly from the inner surface 17 of the cylinder 1.

The O-rings 35, 23 and 24 should each be sized and selected relative to other adjacent components to permit flexing in a manner hereafter described in connection with the dynamic operation of the system. However, conventional O-rings may be used.

Figure 4:
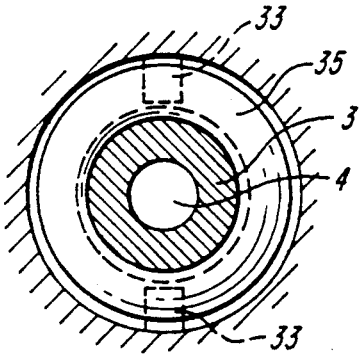
FIG. 4 is a cross sectional view taken substantially along the line 3—3 of FIG. 1.
Figure 5:
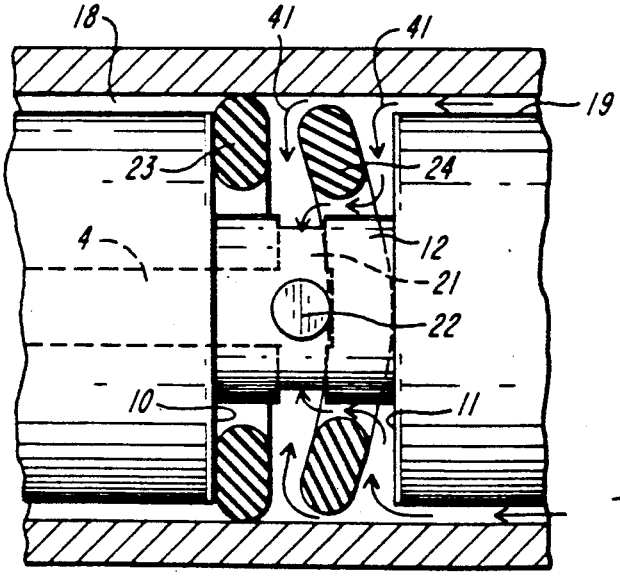
FIG. 5 is a cross sectional view somewhat enlarged taken substantially along the line 4—4 of FIG. 1 but showing the valve mechanism in a dynamic state rather than the static state of FIG. 1.

In the dynamic operation of this pump, the operator will normally connect the valve connection 7 to the valve stem of a bicycle tire or the like. Thereafter, the operator by grasping the projecting end of the piston rod 3 near the outer end 5 in one hand and the cylinder 1 in the other, will cause relative reciprocal movement of the piston and cylinder so that the piston moves in the directions of arrows 40 relative to the cylinder. In this relative movement, chambers 14 and 16 are alternately compressed and expanded. When either of the chambers 14 or 16 is expanded, air is admitted to the chamber in a manner hereafter described. When the chambers 14 and 16 are alternately compressed, the air in the chamber being compressed is forced into the passage 4 through the annular channel 9, opening 21 and air passage 4 into the tire The specific operation of the pump is best understood with reference to FIG. 4. When the piston 2 is moved to the right relative to the cylinder 1, chamber 14 is compressed. As chamber 14 is compressed, the valve 26 (FIG. 1) is maintained closed and the air in the chamber 14 is forced through the annular air passage 18 toward the annular channel 9. The air pressure of this compression causes O-ring 24 to flex about the pair of stop means 22. As the O-ring 24 flexes about the stop means 22, the outer diameter of the O-ring on the axis normal to the stop means 22 moves away from the inner surface 17 of the cylinder 1 to form a temporary air passage through which air may move into the space between the O-ring 24 and the side wall 11 of the piston head 8, as illustrated by the arrows 41. At the same time, the air entering the space between the O-rings, together with the movement of the piston head 8 forces O-ring 23 flush against side wall 10 of the annular channel 9. In this position, O-ring 23 forms an airtight seal at its outer diameter with the inner surface 17 of the cylinder, thus causing the chamber 16 (FIG. 1) to remain sealed at its right end. This prevents air being forced out of chamber 14 from passing into chamber 16. The air then moves through the space between the inside diameter of O-ring 24 and cylindrical base 12, through the opening 21 at the base of the channel 9 (between the O-rings 23, 24) and then through the passage 4 in the piston rod.

As the piston 2 compresses chamber 14, the other chamber 16 is expanded. As chamber 16 expands, air is pulled into chamber 16 through the valve means 30 (FIG. 1). The O-ring 35 is caused to engage the ribs 33 and flex about them, much in the same fashion as the flexing of O-ring 24 except, however, the flexing is in an opposite direction. As the O-ring 35 flexes, its outside spacing surface moves away from sealing contact with the inside facing surface of cylinder end wall 34. This permits air entering through the annular channel 44 between the cylinder end wall 34 and piston rod 3 to pass around the outer diameter of the O-ring and through the annular passage 32 into chamber 16.

When compression of chamber 14 has been completed, chamber 16 has expanded to a maximum. The cycle then is reversed. Under these circumstances, chamber 14 now expands while chamber 16 is compressed. When this occurs, air will continue to be expressed through air passage 4 and out through the end 5 of the piston rod 3. However, the air will be coming from the chamber 16 which is now being compressed, while chamber 14 is being expanded.

During this second phase of the complete cycle, the O-ring 23 is caused to flex about stop means 22 while O-ring 24 is caused to be seated flush against the side wall 11 of annular channel 9. Simultaneously, the movement of piston 2 and compression of chamber 16 cause the O-ring 35 to be maintained flush against the outer end wall 34 of the cylinder 1, thus effecting a seal and preventing air from escaping through passage 44 during the compression of chamber 16. Under these circumstances, air from chamber 16 moves through air passage 18, between the flexed portions of O-ring 23 and side wall 10 of annular chamber 9 and out through the opening 21. At the same time, air is admitted to the expanding chamber 14 through the one-way valve 26.

The process described of alternately compressing chambers 14 and 16 continues until the pumping has been completed.

In the normal use of hand pumps there is a tendency of users to rotate the piston relative to the cylinder as the unit is used. Because of this tendency, the O-rings do not normally flex in the same position each time and therefore do not take a set out of the plane which would otherwise allow leaking. It is preferable that the O-rings be resilient such that they form a sealing relationship with the cylinder walls in a resting state.

While the present invention describes the use of stop means consisting of a pair of pins projecting from the base of the annular channel and stop means consisting of a pair of ribs on an annular wall, other arrangements are also contemplated. For example, it is possible that three or more pins or ribs may be employed. However, two pins or ribs are preferred because an increased number may reduce the flexing capability of the O-ring. It is important only that the stop means and O-ring be constructed and arranged such that air pressure will cause the O-ring to be flexed about the stop means to create an air passage previously sealed by the O-ring.

Figure 6:
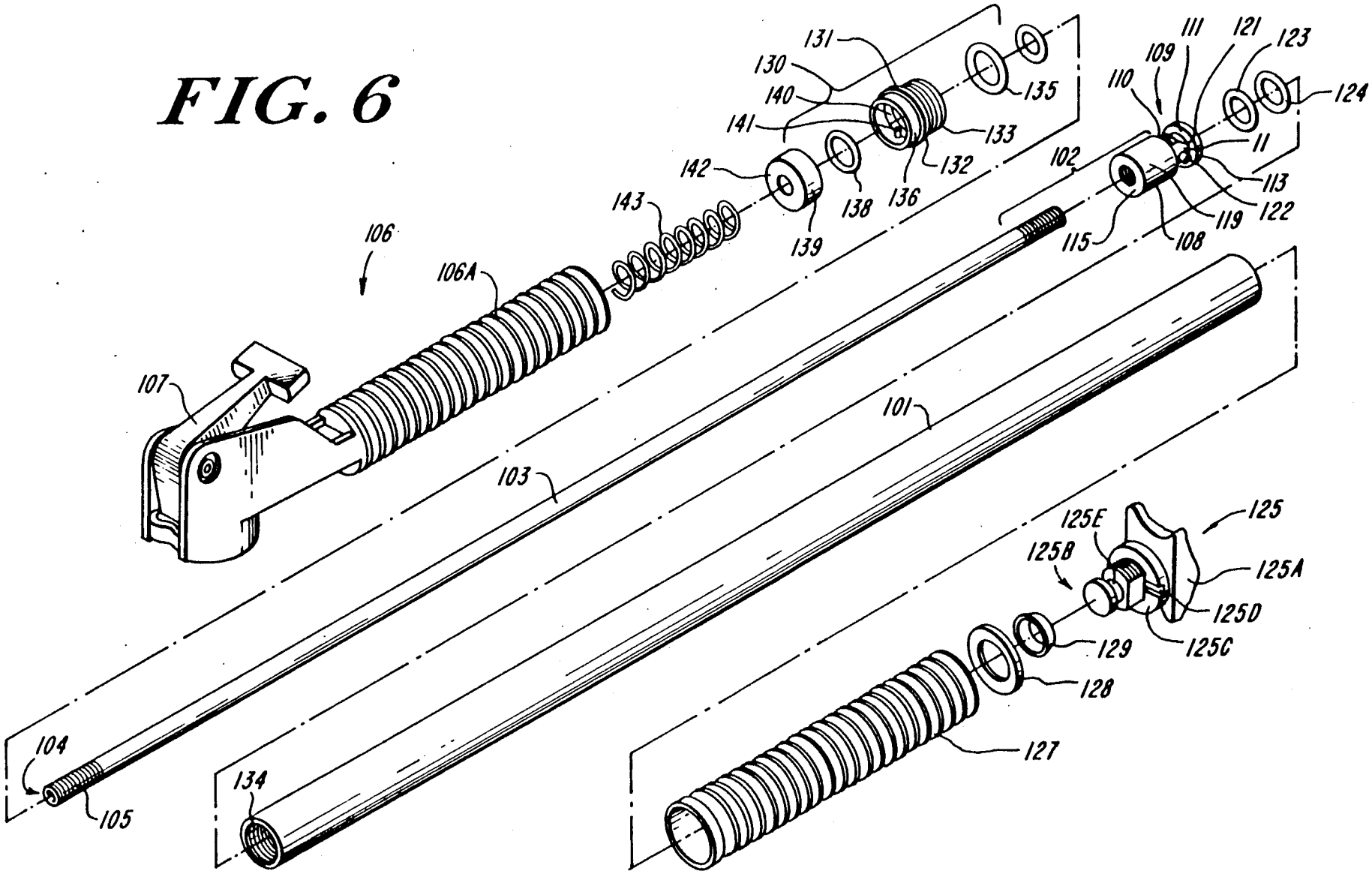
FIG. 6 is an exploded perspective view of a preferred embodiment of the invention used for pumping bike tires.

FIG. 6 illustrates the preferred embodiment of the invention, described in greater constructional detail than the embodiments previously described. In FIG. 6 there is illustrated exploded array of components used for a bicycle pump. In this embodiment, the pump includes an elongated cylinder 101 of conventional shape and formed of plastic. The cylinder 101 is internally threaded at both ends. A piston 102 is adapted to slide longitudinally within the cylinder 101. Piston 102 includes an aluminum tubular piston rod 103 defining a longitudinally extending internal passage 104. The piston rod 103 has two ends: a knurled inner end for attachment to the plastic piston head and a knurled outer end 105 for attachment to the handle portion 106A of pump head 106. In the assembled condition, the piston 102 is slideably received within the cylinder 101 with the outer end 105 of the piston rod 103 extending from the cylinder 101 extending into and attached within hollow handle 106A. The passage 104 at end 103 is a fluid communication via a passage through handle 106A with a valve connection shaped and sized to engage the valve stem of a bicycle tire valve This assembly which includes a locking handle 107 is commonly available in existing bicycle pumps.

The inner end of the piston rod 103 is connected to the plastic piston head 108 which is positioned within the cylinder 101. The piston head 108 is formed with an annular channel 109 defined by parallel side walls 110 and 111 and a cylindrical base 112. The cylindrical base 112 has an opening 121, similar to the opening 21 of the embodiment shown in FIG. 1. This opening is in fluid communication with the passage 104 of piston rod 103. The passage 104 thus extends from the outer end 105 of the piston rod 103 and communicates with opening 121 and the base of the annular channel 109 so that air or fluid may freely pass from the annular channel 109 through the opening 121, into the passage 104 and consequently through the pump head 106 when it is engaged with a bicycle tire valve.

The piston head 108 divides the cylinder 101 into two separate chambers, one end 113 of the piston head 108 faces and defines a chamber within the cylinder 101 similar to chamber 14 of FIG. 1. The opposite end 115 of the piston head 108 faces and defines a second chamber similar to chamber 16 of FIG. 1 within the cylinder 101. Piston head 108 has an outer cylindrical wall that is spaced very closely to the inner surface of the cylinder 101 thus defining an annular air passage between the inner surface of the cylinder 101 and the outer cylindrical wall 119 of the piston head 108. This air passage provides for fluid communication between the chambers and the opening 121 in the base of the annular channel 109 in a fashion similar to that described in connection with the embodiment of FIG. 1. In this preferred arrangement, the outer diameter of the piston head 108 is 0.530" while the inner diameter of the cylinder 101 is 0.559", which means the space between the inner diameter of the cylinder 101 and the outer diameter of the piston head 108 has an average clearance on the order of approximately 0.015". The maximum out of round of the cylinder 101 preferably is about 0.003" or less.

A pair of stop means 122 project radially from the base 112 of the annular channel 109 in normal alignment with the opening 121 in a fashion similar to the corresponding arrangements in FIG. 1. Preferably, these stops consist of pins or the like.

A pair of O-rings 123 and 124 are positioned about the annular channel 109, sandwiched about the stop means 122. The adjacent sides of the O-rings 123 and 124 engage the stop means 122 and their respective outer sides engage respectively the side walls 110 and 111 of the annular channel 109. The inner diameter of the O-rings 123 and 124 are larger than the cylindrical base 112 of the annular channel 109. In the embodiment shown, the inner diameter of the O-rings is 0.362" compared with an outer diameter of 0.325" of the cylindrical base 112. The outer diameter of the O-rings 123 and 124 is 0.568" in a non-stressed position, which is larger than the inner diameter of the cylinder 101, 0.559". The O-ring is substantially cylindical in cross-section with a thickness of about 0.103". Thus, to accommodate the O-rings 123 and 124 within the cylinder 101, the O-rings are normally compressed to the inner diameter of the cylinder 101. In the normal non-dynamic state, the outer diameter of the O-rings 123 and 124 are pressed in firm but sliding engagement with the inner surface of the cylinder 101.

Figure 7:
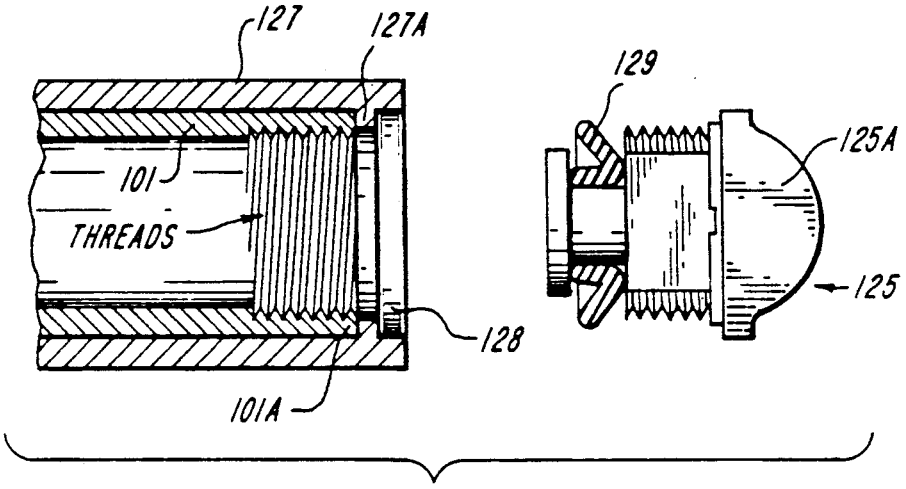
FIG. 7 is an exploded cross-sectional view of an end of the assembly shown in FIG. 6.

A handle 127 (FIGS. 6 and 7) is telescopically fitted over the end 101A of the cylinder 101 opposite the valve pump head 106. The handle 127 has an inwardly extending annular lip 127A which on one side abuts against the end 101A of the cylinder 101 and on the other side forms a seat for receiving a filter 128. A cap 125 is secured to the end 101A of the cylinder 101 to hold the handle and filter in place. The cap 125 has a cap head 125A and an axially extending male projection 125B for threadedly engaging the cylinder end 101A. The cap head 125A has a generally flat, peripheral seating flange 125C which acts together with the end 101A of the cylinder 101 to capture and hold in place the annular lip 127A and the filter 128. The portion of the male projection closest the cap head 125A is threaded, with two sides flattened. Grooves 125D extend along the seating flange 125C from its peripheral edge to the flattened surfaces. When the cap 125 is threaded onto the cylinder 101, the filter 128 is compressed into these grooves, the grooves and filter forming air filter passages from outside the cylinder to inside the cylinder.

The male projection 125B of the cap 125 terminates in a channel 125E which receives an O-ring 129, "V" shaped in cross-section. The outside diameter of this "V"-ring 129 is greater than the inside diameter of the cylinder 101, such that a seal is formed preventing passage of air out of the cylinder, but not into the cylinder. This arrangement is of conventional design and is shown in U.S. Pat. No. 3,981,625.

Passage of air into the chamber formed on the opposite side of the piston head 108 is controlled by a valve assembly generally illustrated at 130. This valve assembly 130 closes off the end 134 of the cylinder 101 through which the piston rod 103 extends. The valve assembly 130 includes sleeve 131 having an outer annular flange 132 intermediate its ends. A threaded end 133 of the sleeve 131 is threaded into end 134 of the cylinder 101. A sealing washer 135 fits between the end 134 of the cylinder 101 and the flange 132. The opposite end of the sleeve 101 defines a sleeve cylinder 136, having an outside surface for telescopically receiving a sleeve cap 139 and an inside channel for receiving an O-ring 138. The O-ring 138 preferably has an inner diameter of 0.299 and an outer diameter of 0.505. The O-ring then fits within the inside channel which has an inner diameter of 0.530. The sleeve 131 also has an inwardly extending, radial flange 140 having a plurality of stops 141 similar to the arrangement shown in FIGS. 1 and 4. The cap 139 is coaxially mounted on and frictionally engages the sleeve cylinder 136 to capture the O-ring 138 within the inside channel of the sleeve 131 between the cap end wall 142 and stops 141.

An expansion helical spring 143 coaxially mounted on the rod 103 normally fits within the handle 106A and exerts an axial force on the cylinder 101 through its engagement with a cap 139. This is a conventional arrangement providing an expansion force for storing the pump on a frame mount. A floating O-ring 137 fits snugly over the rod 108 and is adapted to protect the end 115 of the piston head 108 from contacting the sleeve 131. The inner diameter of the floating O-ring in this embodiment shown is 0.299", and therefore is fixed tightly about the rod 103 which has an outer diameter preferably of 0.315.

This embodiment works in a fashion similar to that described in FIG. 1. On the reciprocal relative movement of the cylinder 101 and piston 102, flexing of the O-rings 123 and 124 occurs in a manner which causes the air to pass into the opening at the base 112 of the channel 109 and out through the piston rod 103. When the piston 102 is moved toward the end 101A of cylinder 101, O-ring 123 is unflexed wile O-rings 124 and 138 are flexed. When the piston 102 is moved toward the end 134 of cylinder 101, O-rings 124 and 138 are unflexed while O-ring 123 is flexed.

Having now described my invention, I claim:

1. An air pump having a cylinder with an inner cylindrical surface and a piston positioned for reciprocal movement within the cylinder and defining a chamber on each side of the piston, the piston having a tubular piston rod forming an air passage, a piston head with an annular channel formed in the head and an opening in the base of the channel in communication with the air passage, a pair of O-rings seated in and coaxial with the base of the channel, the O-rings in a non-dynamic state normally engaging the inner surface of the cylinder to seal the chambers from the channel, and stop means sandwiched between the O-rings that contacts the surface of each of the O-rings at a limited number of arcuate portions about the circumference equalling substantially less than 360 degrees and adapted on relative movement of the piston and cylinder to cause flexing of one of the O-rings about the stop means depending on the direction of the relative movement from contact with the inner surface whereby air may pass from one chamber through the channel into the opening.

2. A pump comprising, a cylinder having an inner wall and a piston in the cylinder, the piston having a piston head with an annular channel, means for forming an air passage from the channel outwardly of the pump through the piston, an O-ring seated in the channel with the O-ring having an outer diameter normally providing an air seat between the piston and the inner wall of the cylinder, and means for flexing the O-ring out of contact with the inner wall to break the seal on movement of the piston, wherein the means for flexing comprises means projecting into the channel for engagement with a limited arcuate portion of the O-ring surface on flexing of the O-ring.

3. A pump comprising, a cylinder having an inner wall and a piston in the cylinder, the piston having a piston head with an annular channel, means forming an air passage from the channel outwardly of the pump through the piston, a pair of O-rings seated in the channel with the O-rings having an outer diameter normally providing an air seal between the piston and the inner wall of the cylinder, and means for flexing the O-rings out of contact with the inner wall to break the seal on movement of the piston, said means for flexing being sandwiched between and adapted to flex both of the O-rings and further comprising means projecting into the channel for alternate engagement with limited arcuate portions of the surface of the O-rings on axial movement of the piston.

4. A pump comprising, a cylinder having an inner wall and a piston in the cylinder, the piston having a piston head with an annular channel, means forming an air passage from the channel outwardly of the pump through the piston, a pair of O-rings seated in the channel with the O-rings having an outer diameter normally providing an air seal between the piston and the inner wall of the cylinder, and means for flexing the O-rings out of contact with the inner wall to break the seal on movement of the piston, said means for flexing being sandwiched between and adapted to flex both of the O-rings and further comprising means projecting into the channel for alternate engagement with limited arcuate portions of the surface of the O-rings on axial movement of the piston, said means including a pin secured to the base of the channel intermediate the O-rings and adapted to engage a side of each of the O-rings with the other sides of the O-rings adapted to be engaged by the side walls of the channel.

5. In a pump construction having a cylinder with an inner wall and a piston slidable therein, a one way valve for sealing or opening an air passage between a piston rod passing through an end of the cylinder comprising, an O-ring snugly and slideably fitted about the piston rod within the cylinder, the outside diameter of the O-ring spaced from the inner wall of the cylinder, a pair of walls having opposing surfaces sandwiching the O-ring, one of the surfaces constructed and arranged to form an air-tight seal with one side of the O-ring and the other of the surfaces having stop means projecting therefrom toward the O-ring adapted on relative movement of the piston and cylinder in one direction to cause flexing of the O-ring about the stop means whereby a passage is formed allowing air to enter the cylinder.

6. A one way valve as claimed in claim 5 wherein the O-ring is held snugly between the stop means and the surface with which the O-ring forms an air-tight seal.

7. An air pump having a cylinder with an inner cylindrical surface and a piston positioned for reciprocal movement within the cylinder and defining a chamber on each side of the piston, the piston having a tubular piston rod forming an air passage, a piston head with an annular channel formed in the head and an opening in the base of the channel in communication with the air passage, a pair of sealing members seated in and coaxial with the base of the channel, the sealing members in a non-dynamic state normally engaging the inner cylindrical surface to form a seal, and with the inner diameter of the pair of sealing members spaced from the base of the channel and forming an annular passage therebetween, stop means sandwiched between the sealing members and adapted on relative movement of the piston and cylinder to cause flexing of one of the sealing member about the stop means depending on the direction of the relative movement from contact with the inner surface wherein the stop means is constructed and arranged to contact the sealing members in a manner that flexing brings the outer perimeter of the sealing member out of contact with the cylinder's inner cylindrical surface.

8. A structure as set forth in claim 7 wherein said sealing members normally engage side walls of the channel.

9. A structure as set forth in claim 8 wherein said sealing members are O-rings.

10. A pump comprising, a cylinder having an inner wall and a piston in the cylinder, the piston having a piston head with an annular channel, means forming an air passage from the channel outwardly of the pump through the piston, an O-ring seated in the channel with the O-ring having an outer diameter normally providing an air seal between the piston and the inner wall of the cylinder, and means for flexing the O-ring to break the seal on movement of the piston, wherein said O-ring in a non-dynamic state normally engages the channel side wall, wherein the inner diameter of said O-ring in a non-dynamic state is spaced from the base of the channel and forms an annular passage therebetween, and wherein the means for flexing contacts the surface of the O-ring at two arcs thereon equalling substantially less than 360 degrees.

11. A structure as set forth in claim 10 wherein the means for flexing is a pin means projecting into the channel for engagement with the O-ring.

12. A structure as set forth in claim 11 wherein the pin means extends substantially across a cross-section of the O-ring.

13. A structure as set forth in claim 12 further comprising a pair of O-rings seated in and coaxial with the base of the channel.

14. A structure as set forth in claim 13 wherein the pin means is secured to the base of the channel intermediate the O-rings and adapted to engage an arc on one surface of each of the O-rings with the opposite surface of the O-rings adapted to be engaged by the side walls of the channel.

15. A structure as set forth in claim 14 wherein the O-rings include a circular cross-section on a plane perpendicular to a plane formed by a circumference of the O-rings and intersecting a center point of the circumference.

* * * * *